United States Patent [19]

Ullrich et al.

[11] 4,073,728

[45] Feb. 14, 1978

[54] PROCESS FOR TREATING FLUSHING LIQUOR

[75] Inventors: Hansjürgen Ullrich; Heinz Dippel; Karl Loss, all of Bochum, Germany

[73] Assignee: Dr. C. Otto & Comp. G.m.b.H., Bochum, Germany

[21] Appl. No.: 754,502

[22] Filed: Dec. 27, 1976

[30] Foreign Application Priority Data

Dec. 27, 1975 Germany ..... 2558857

[51] Int. Cl.[2] ..... B01D 35/18; C02B 1/02

[52] U.S. Cl. ..... 210/71; 208/39; 210/78; 210/83; 210/73 R; 210/73 W

[58] Field of Search ..... 210/65, 71, 72–74, 210/78, 83–86, 97, 98, 109; 208/39, 187, 340

[56] References Cited

U.S. PATENT DOCUMENTS

| | | | |
|---|---|---|---|
| 2,524,859 | 10/1950 | Van Dongen | 208/39 |
| 3,047,214 | 7/1962 | Downing | 208/187 |
| 3,208,201 | 9/1965 | Oliver | 210/179 |

*Primary Examiner*—Frank W. Lutter

*Assistant Examiner*—Frank Sever

*Attorney, Agent, or Firm*—Thomas H. Murray

[57] ABSTRACT

Flushing liquor from a gas main of a coke oven is fed into a preliminary gravity separator to provide an aqueous liquid phase substantially free of tar and solids for reuse as flushing liquid in the gas main. A tar phase obtained from the preliminary gravity separator is fed into a circuit including a centrifuge for three-phase clarification and separation. The circulation in the circuit being at quantities greater than the quantities of the tar phase introduced per unit of time from the gravity separator to obtain a tar surplus which is substantially free of aqueous liquid and thick tar. The tar surplus is removed from the circuit by feeding clean tar from the centrifuge into an overflow tank from where clean tar is reintroduced into the circuit and clean tar is returned to the preliminary gravity separator in controlled response to the tar level therein. The process further includes heating the tar phase in the circuit to a predetermined temperature for optimum three-phase clarification and separation by the centrifuge.

7 Claims, 1 Drawing Figure

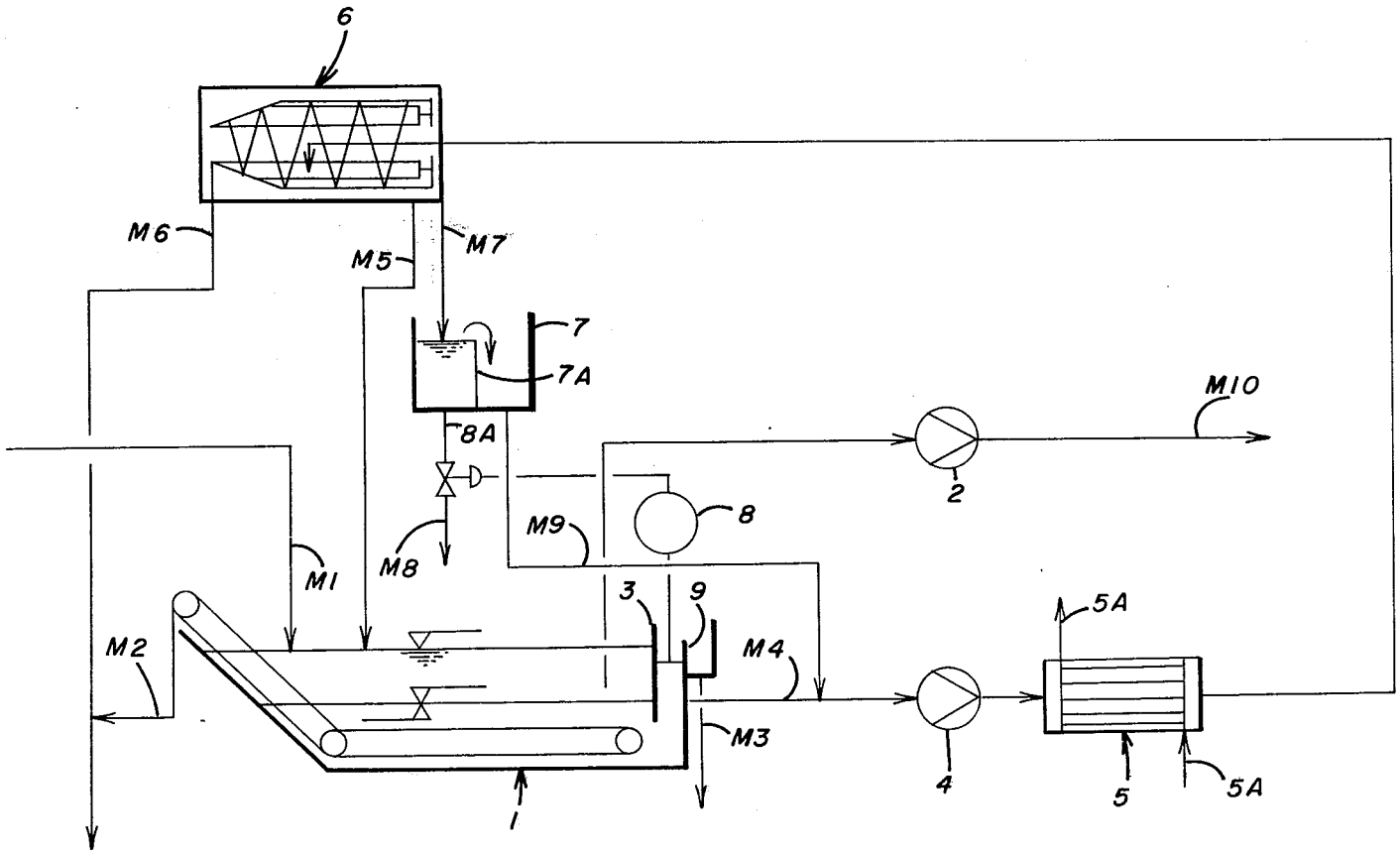
M10
5A
5A
5
2
4
8
M4
M3
9
3
7
7A
M9
1
M7
8A
M8
M5
6
M1
M6
M2

PROCESS FOR TREATING FLUSHING LIQUOR

BACKGROUND OF THE INVENTION

This invention relates to a process for treating washing liquor from the gas main of coke ovens to obtain both an aqueous liquid substantially tar and solid-free which is suitable for reuse as the washing liquid in the gas main and to obtain tar having a low water and a low solids content.

Most coke ovens presently in operation include a widegas main extending along the oven battery for conducting gases liberated in the distillation process from the coking chambers. A negative pressure is developed in the gas main to withdraw and conduct the gases along the gas main. In the gas main, sufficient quantities of water trickle through the gas stream to considerably reduce the temperature of the gas and to separate out various constituents of the gas, particularly tar and solids. The materials removed from the gas by the water are carried in the form of a washing liquor which flows along the bottom of the gas main. It is essential and the usual practice to remove the tar and solid ingredients present in the gas main washing liquor before the liquid is returned to the gas main to wash additional quantities of gas. In the separation process, the tar yield should have a very low solids content for convenience of storage of the tar and a very low water content to facilitate further processing of the tar.

Equipment known in the art for treating such flushing liquor is very large and the separation process requires a relatively long period of time. Moreover, the separation process is often unsatisfactory because unacceptable quantities of solids and water remain in the tar. To intensify the separation process, which is based on gravity, the width or length of the tanks used for the separation process must be increased correspondingly. Thus, more floor space is needed and capital investment costs are considerably increased.

In modern coke oven batteries, the trend is for an increase in the solids content in the gas passed into the gas main and, therefore, the solids content of the washing liquid and tar is also increased. As the carbonization time by a coke oven battery is reduced, changes occur to the composition of the tar including an increased quantity of pitch. The treating process for the mixture of water, tar and solids yielded from gas mains of modern coke oven batteries is an undertaking which has become increasingly difficult and more expensive.

Endeavors to alleviate the above disadvantages include gravity settling processes wherein the gas main washing liquor is separated into water, low solids tar and high solids or thick tar by a gravity in a tar separator. In other known processes, the washing liquor is passed seriatium through a preliminary separator, for separating large lumps of thick tar therefrom, and then through a tar separator wherein the washing liquor is separated into water, tar and thick tar phases. The tar can then be passed through another separator wherein, as in all the facilities hereinbefore mentioned, there is considerable gravity separation of water and solids from the tar. Thereafter, the tar is frequently subjected to further dewatering in large heated settling and storage tanks. In other known processes, the tar received from each gravity separator is passed into a decanting centrifuge for separation of the solids therefrom before the tar is passed into the storage tank.

SUMMARY OF THE INVENTION

It is an object of the present invention to provide an improved process for treating washing liquor from the gas main of a coke oven while at the same time obtaining from the process an aqueous liquid which is suitable for reuse in the gas main and a clean tar yield which is substantially free of solids to readily permit storage and substantially free of water to readily enable further processing of the tar.

It is a further object of the present invention to provide a process for treating washing liquor from a gas main in a coke oven battery wherein apparatus to carry out the process requires considerably less space than apparatus used in known processes while providing satisfactory separation of components of the washing liquor including a tar phase having high solids and pitch content.

In accordance with the present invention, there is provided a process for treating flushing liquor discharged from a gas main of a coke oven to obtain an aqueous liquid substantially free of tar and solids suitable for reuse as flushing liquid in the gas main and to obtain tar having a low water and solids content, the process including the steps of separating the flushing liquor in a preliminary gravity separator into an aqueous liquid phase substantially free of tar and solids and into a tar phase, feeding the tar phase into a circuit including a centrifuge for three-phase clarification and separation, the circulation in the circuit being at quantities greater than the quantities of the tar phase introduced per unit of time from the preliminary gravity separator to obtain a tar surplus substantially free of aqueous liquid and thick tar, and removing the tar surplus from the circuit while returning the aqueous liquid and thick tar to the circuit.

Thus, according to the present invention, the washing liquor discharged from a gas main of a coke oven which contains tar and solids, is separated by gravity in a preliminary separator into an aqueous liquid substantially free from tar and thick tar. The term "thick tar" as used herein is defined and intended to mean a mixture of pieces of coal, coke or ore and the relatively high molecular weight pitch constituents of the tar. The aqueous liquid discharged from the preliminary separator is sufficiently cleaned for reuse in the gas main as washing liquid and, therefore, can be returned to the gas main by a pumping circuit including a pump. The tar phase which has been separated out in the preliminary separator is still inadequately free of water and thick tar. This tar phase is supplied in quantities greater than the average amount of tar yielded per unit of time from a circuit which includes a pump and a centrifuge for three-phase clarifying and separating. In this circuit, most of the water and thick tar are separated from the tar phase to provide a yield of clean tar. The clean tar yield is in the form of a surplus in the circuit which is separated and removed as a product while other components of the tar circuit are returned to the circuit including the centrifuge.

Since the tar-phase flow in the circuit is constantly being adjusted to a value above the maximum yield of clean tar, constant operating conditions are insured and the quality of the clean tar product remains constant. The tar circuit comprises a tar pump receiving the tar phase from a chamber of the preliminary separator. The tar circuit further includes a three-phase clarifying and separating centrifuge which may be in the form of a nozzle separator or of a self-cleaning separator, preferably an imperforated basket screw centrifuge. The three-phase clarifying and separating process is always carried out by centrifugal force used to produce the tar-to-water separation.

To improve the quality of the clean tar yield in the process of the present invention, the flow of the tar phase is heated before entry into the centrifuge. This heating is carried out in a heat exchanger to provide an optimum temperature for the centrifugal separation process. When the process includes heating the tar flow in the circuit, then surplus tar is returned directly to the intake side of the pump to thereby reduce unnecessary heat losses.

A further feature of the process according to the present invention provides that the separation process may be executed in a conventional manner employing only the process of gravity settling for separation of the washing liquor in the event of a failure in the centrifuge circuit that interrupts the process for producing clean tar. The process enables such a mode of operation provided that the poor quality end product can be accepted for the duration of the failure.

These features and advantages of the present invention as well as others will be more fully understood when the following description is read in light of the accompanying drawing which schematically illustrates various apparatus for use in carrying out the steps of the process according to the present invention.

Conduit line M1 conducts washing liquor containing tar and solids to a gravity separator 1 for preliminary cleaning. In gravity separator 1 the washing liquor is separated into tar, thick tar and an aqueous liquid (e.g., water). The gravity separator 1 may be of any conventional well known construction. One such form of a gravity separator is shown in U.S. Pat. No. 3,923,659 which is assigned to the same Assignee as the present invention. The gravity separator 1 includes a tank with a conveyor in the bottom thereof for mechanically removing thick tar which is received and conducted away from the tank by line M2. The aqueous liquid or water is conducted by line M10 from the separator 1. Line M10 includes a pump 2 for returning the liquid for further washing of gases discharged into a gas main of a coke oven battery.

A tar phase is delivered by line M4 by way of an overflow pipe 3 from the preliminary separator. The tar phase in line M4 has a temperature of about 70° C and a water content of between 3 and 15%. A pump 4 delivers the tar phase to a heat exchanger 5 wherein the tar phase undergoes heating by steam delivered by lines 5A to the exchanger. The tar phase is heated in the heat exchanger to an optimum temperature of between 80° C and 98° C to undergo further separation in a three-phase clarifying and separating centrifuge 6. The centrifuge includes a vessel containing the heated tar phase which is to be centrifuged and a drive for rotating the vessel at a high speed within a housing or the like to thereby separate solids held in suspension in the tar phase and liquid, e.g., water, from the tar on the basis of the differences in their density.

In the centrifuge 6, the tar phase is given a final cleaning treatment whereby it is separated into water, clean tar and thick tar. Line M5 conducts the water separated by the centrifuge for return to the preliminary separator 1. Thick tar is delivered from centrifuge 6 by line M6 which is joined with line M2 conducting the thick tar delivered from the preliminary separator for removal from the circuit. Clean tar is delivered by line M7 from the centrifuge to an overflow tank 7. The clean tar delivered to the tank 7 has a water content of approximately 2%. Conduit M8 delivers the tar from the overflow tank in quantities so as to maintain a desired tar level within the preliminary separator 1. In this regard, the tar level in separator 1 should remain constant or substantially constant. To achieve the delivery of tar from tank 7 in desired quantities, a level control 8 responds to the tar level in preliminary separator 1 for controlling a control valve 8A which is provided in line M8 used to deliver the tar from the main storage compartment in overflow tank 7. A weir 7A in the overflow tank permits an excess of clean tar to flow from the main containing portion thereof into an overflow container where the clean tar is conducted by line M9 to line M4 at the intake side of pump 4.

In the event of a failure to the centrifuge circuit, then the process of the present invention is so devised that tar can be continually separated out of the flushing liquor by employing only the preliminary separator 1. However, the quality of the end tar product is impaired. Until the centrifuge circuit is again placed in operation, the tar is discharged from the preliminary separator as a mass flow in line M3 from an overflow 9 of the preliminary separator.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A process for treating flushing liquor discharged from a gas main of a coke oven to obtain an aqueous liquid substantially free of tar and solids suitable for reuse as flushing liquid in the gas main and to obtain tar having a low water and solids content, said process including the steps of:

separating said flushing liquor in a preliminary gravity separator into an aqueous liquid phase substantially free of tar and solids and into a tar phase, using said aqueous liquid phase for washing gases in said gas main of a coke oven, feeding said tar phase into a circuit forming a closed loop which includes a pump and a centrifuge for three-phase clarification and separation, the circulation in said circuit being at a flow rate greater than that of said tar phase which is introduced from said preliminary gravity separator said flow rate being sufficient to provide substantially constant operating conditions within said process and said circuit functioning to provide three-phase separation of said tar phase, withdrawing clean tar which is substantially free from contaminants, from said circuit at a flowrate less than the flow rate of said tar phase in said circuit, withdrawing an aqueous liquid from the centrifuge for subsequent use in the circuit, and withdrawing a thick tar from the centrifuge out of the circuit.

2. The process for treating flushing liquor according to claim 1 including the further step of heating said tar phase to a predetermined temperature for optimum three-phase clarification and separation by said centrifuge.

3. The process for treating flushing liquor according to claim 2 wherein said tar phase is heated by said step of heating to a temperature within the range of 80° C to 98° C.

4. The process for treating flushing liquor according to claim 1 wherein said centrifuge includes an imperforated basket screw centrifuge.

5. The process for treating flushing liquor according to claim 1 wherein said removing said tar surplus includes feeding clean tar from said centrifuge into an overflow tank, and controlling the discharge of clean tar from said overflow tank in response to the tar level in said preliminary gravity separator.

6. The process for treating flushing liquor according to claim 5 wherein said controlling the discharge of clean tar includes using a weir in said overflow tank to form a compartment for returning clean tar into said circuit.

7. The process for treating flushing liquor according to claim 1 wherein said centrifuge includes an integral pump to circulate said tar phase in said circuit.

* * * * *